United States Patent [19]

Shapland et al.

[11] 4,415,103

[45] Nov. 15, 1983

[54] FULL THROTTLE VALVE AND METHOD OF TUBE AND GATE CHANGE

[75] Inventors: Earl P. Shapland, Sarasota, Fla.; Patrick D. King, Rantoul, Ill.

[73] Assignee: USS Engineers and Consultants, Inc., Pittsburgh, Pa.

[21] Appl. No.: 225,895

[22] Filed: Jan. 19, 1981

Related U.S. Application Data

[63] Continuation-in-part of Ser. No. 73,588, Sep. 7, 1979, abandoned, which is a continuation-in-part of Ser. No. 945,441, Sep. 25, 1978, abandoned, which is a continuation-in-part of Ser. No. 732,867, Oct. 15, 1976, abandoned.

[51] Int. Cl.[3] ..... B22D 37/00; B22D 41/08

[52] U.S. Cl. ..... 222/590; 222/600; 222/603

[58] Field of Search ..... 222/600, 590, 504, 559, 222/603; 251/205, 289

[56] References Cited

U.S. PATENT DOCUMENTS

| | | | |
|---|---|---|---|
| 311,902 | 2/1885 | Lewis | 222/600 |
| 808,810 | 1/1906 | Brookfield | 222/600 X |
| 3,731,912 | 5/1973 | Kutzer | 222/600 |
| 3,765,579 | 10/1973 | Cramer et al. | 222/600 |
| 3,779,431 | 12/1973 | Tinnes et al. | 222/600 |
| 3,866,806 | 2/1975 | Shapland | 222/600 |
| 3,918,613 | 11/1975 | Shapland et al. | 222/603 |
| 4,168,790 | 9/1979 | Lothmann et al. | 222/600 |

FOREIGN PATENT DOCUMENTS

| | | | |
|---|---|---|---|
| 2104561 | 2/1972 | Fed. Rep. of Germany | 222/603 |
| 2702436 | 7/1977 | Fed. Rep. of Germany | 222/600 |

*Primary Examiner*—David A. Scherbel
*Attorney, Agent, or Firm*—John F. Carney

[57] ABSTRACT

A sliding gate valve of the type in which refractory gates are sequentially disposed in operative position beneath the pour opening from a teeming vessel, such as a tundish, is effective to controllably throttle the metal flow stream from the vessel. Separate drives are employed for disposing the gates in their operative position within the valve mechanism and for positioning the gates to control the degree of throttling of the flow stream from the vessel whereby the gates can be changed without altering the throttling configuration of the valve. Additionally the valve is adapted to accommodate pour tube attachments which may be changed either in conjunction with changes of the slide gates or independently thereof. The valve mechanism and its replaceable refractory components are designed for the supply of fluids for cooling these members and for the injection of fluid reactants into the metal pouring process.

123 Claims, 13 Drawing Figures

FULL THROTTLE VALVE AND METHOD OF TUBE AND GATE CHANGE

RELATED APPLICATIONS

This application is a continuation-in-part of U.S. Patent Application Ser. No. 73,588, filed Sep. 7, 1979 which is a continuation-in-part of U.S. patent application Ser. No. 945,441 filed Sep. 25, 1978 which is a continuation-in-part of U.S. patent application Ser. No. 732,867, filed Oct. 15, 1976 all of said applications now abandoned.

BACKGROUND OF THE INVENTION

The present invention relates to the pouring of molten metal from teeming vessels. More particularly, it relates to valve apparatus for controlling the flow of molten metal from a teeming vessel into a receiver, such as, for example, the mold of a continuous caster.

In U.S. Reissue Patent No. 27,237, granted Nov. 23, 1971 to J. T. Shapland, there is described a valve apparatus for controlling the flow of metal from a bottom-pour vessel. The described valve incorporates refractory plates that are adapted to be moved in sequence into an operative position beneath the pour opening of the vessel. The plates utilized are either blank, imperforate members operative to prevent the flow of metal from the vessel or contain orifice openings sized to control the rate of metal teemed from the vessel. Flow regulation is achieved in such valve by selectively moving plates containing different diameter orifice openings in sequence into their operative position beneath the vessel pour opening.

Teeming valves of the described type are beneficial in that plate change is rapidly effected such that metal flow can be promptly terminated in the case of the development of a hazardous condition. The valves are also beneficial in that changes in flow conditions for regulation purposes can be achieved in a minimum of time. Such valves, however, suffer from the disadvantage that the rate of flow through the valve can be regulated only by replacing the operative slide plate with one having an orifice opening of different diameter, thus precluding the ability to vary flow rates over an infinitely variable range. The need to change plates in order to alter metal flow conditions also renders the use of such prior art valves costly in that the number of plates utilized over a period of valve operation is increased and a large number of plates containing orifice openings of different diameters must be inventoried.

Infinitely variable metal teeming valves are not new as evidenced by U.S. Pat. No. 3,436,023, 3,454,201 and 3,866,806. However, none of these valves have the ability to maintain the flow throttling function of the valve completely independent of the emergency shutoff function. Accordingly, not only is rapid response to an unsafe condition requiring termination of flow unattainable with their use but also immediate return of flow to the regulated flow rate upon reinstatement of teeming is impossible.

It is to the solution of these and other problems attendant with the use of prior art metal teeming valves that the present invention is directed.

SUMMARY OF THE INVENTION

Accordingly, the present invention is directed to an improved sliding gate valve organization of the type in which successive slide plates are sequentially positionable with respect to the pour opening of a teeming vessel and in which the sliding plate can throttle the metal flow from the vessel over an infinitely variable range between the fully open condition of the valve to its fully closed condition.

The invention further improves upon prior art valves of the described type in that means are provided which enable throttling to occur over a partial range of metal flow or, alternatively, over the full range of metal flow without the need to change slide plates.

The described sliding gate valve organization is also characterized by the ability to rapidly insert a blank plate when it is desired to terminate metal flow for safety or other reasons and with the ability to change pour tubes either in conjunction with or independently from a slide plate change.

Yet another feature of the present invention is the provision of a sliding plate of particular configuration in teeming valves of the described type that enables its rapid insertion into its operative, sealed position between the valve top plate and the pour tube support plate without danger of damaging either of these refractory members.

Also contemplated by the present invention is a top plate of particular configuration that enables the effective distribution of inert gas injection into the vessel pour opening when the valve is in its closed condition, such plate being configured to permit its fabrication by conventional refractory-forming processes without the need for expensive machining.

Yet another feature of the hereindescribed sliding gate valve organization is the provision of means to effectively supply cooling air to the valve parts which are most sensitive to a high temperature atmosphere, including the seal springs and the refractory parts forming the pour opening of the vessel thereby reducing thermal deterioration of these parts.

A still further feature of the hereindescribed arrangement are means to promote reduced turbulence in the metal flow stream through the valve that may otherwise occur at reduced flow rates when the metal flow passage is restricted.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
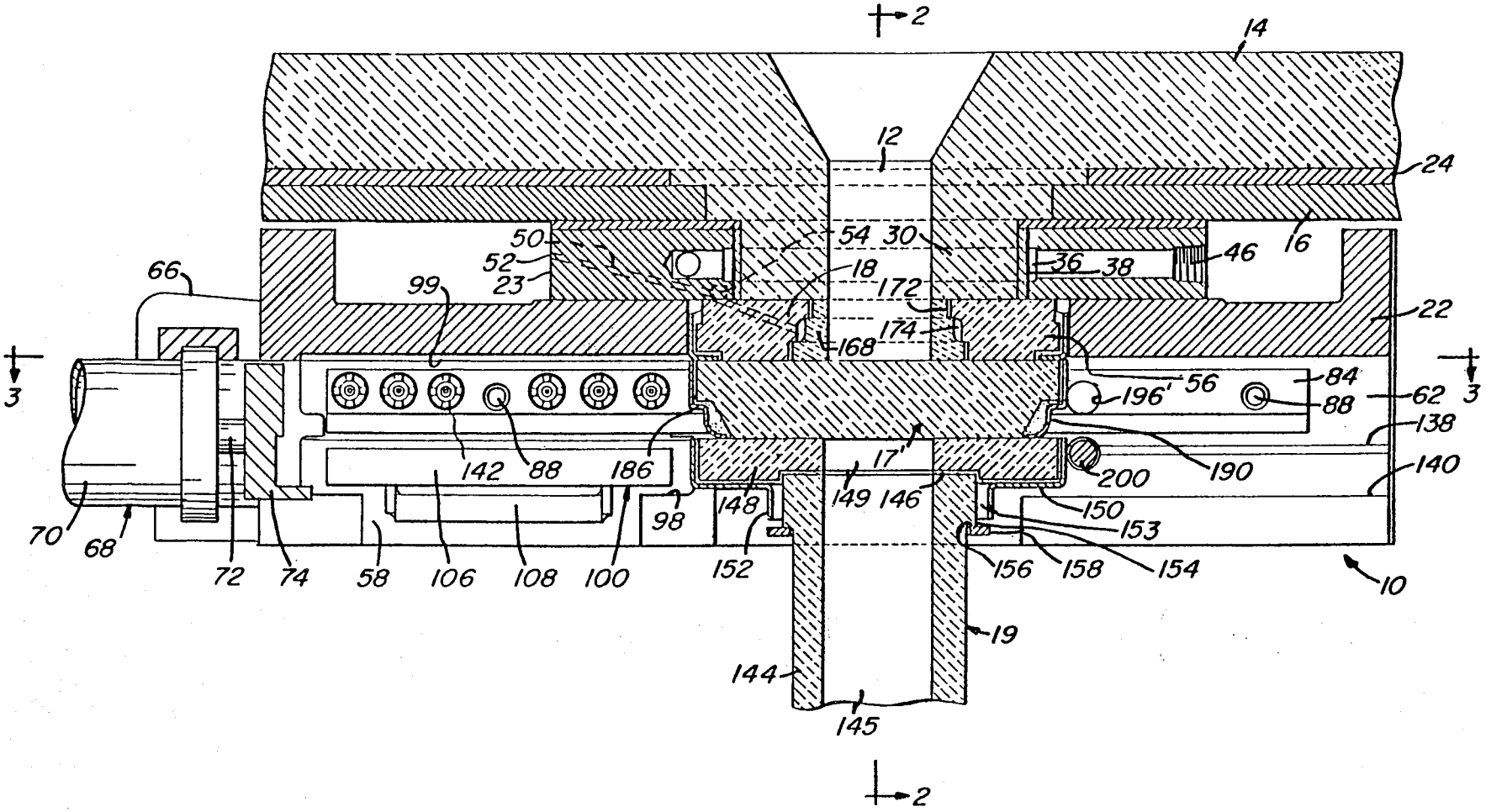
FIG. 1 is a vertical sectional view of the sliding gate valve of the present invention.
Figure 2:
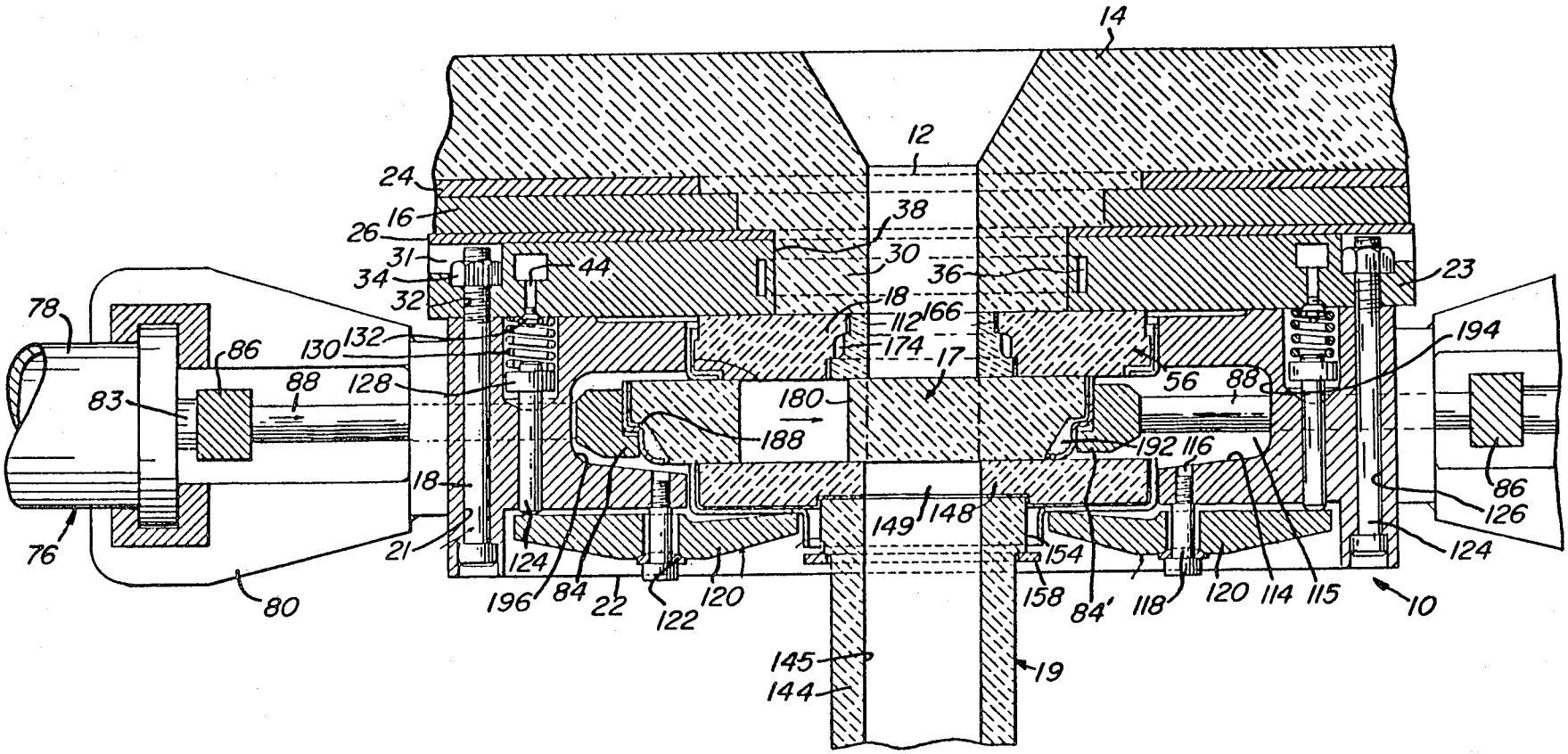
FIG. 2 is a vertical sectional view taken along line 2—2 of FIG. 1.

In FIGS. 1 and 2 of the drawings there is shown a sliding gate valve organization 10 adapted for installation in operative relation to the pour opening 12 in the lining 14 of a teeming vessel 16, such as a tundish or the like, for teeming molten metal to the mold of a continuous caster (not shown). Teeming is controlled by the manipulation of refractory slide plates, that may be orificed as shown at 17 in FIGS. 2, 6 and 7 or blank as shown at 17' in FIG. 1, with respect to a refractory top plate 18. The organization 10 also includes replaceable pour tube assemblies 19 that form extensions of the valve for conducting the teemed molten metal stream to a caster mold. The valve organization 10 is adapted for mounting to the vessel 16 by means of threaded connectors 20 extending through holes 21 in the frame 22 attaching the same to the mounting plate 23 which is, in turn, attached to the vessel by means of bolts (not shown) that connect with a nut plate 24 underlying the vessel lining 14. A heat insulating pad 26 formed of asbestos, or the like, may be interposed between the mounting plate 23 and the vessel 16.

Figure 4:
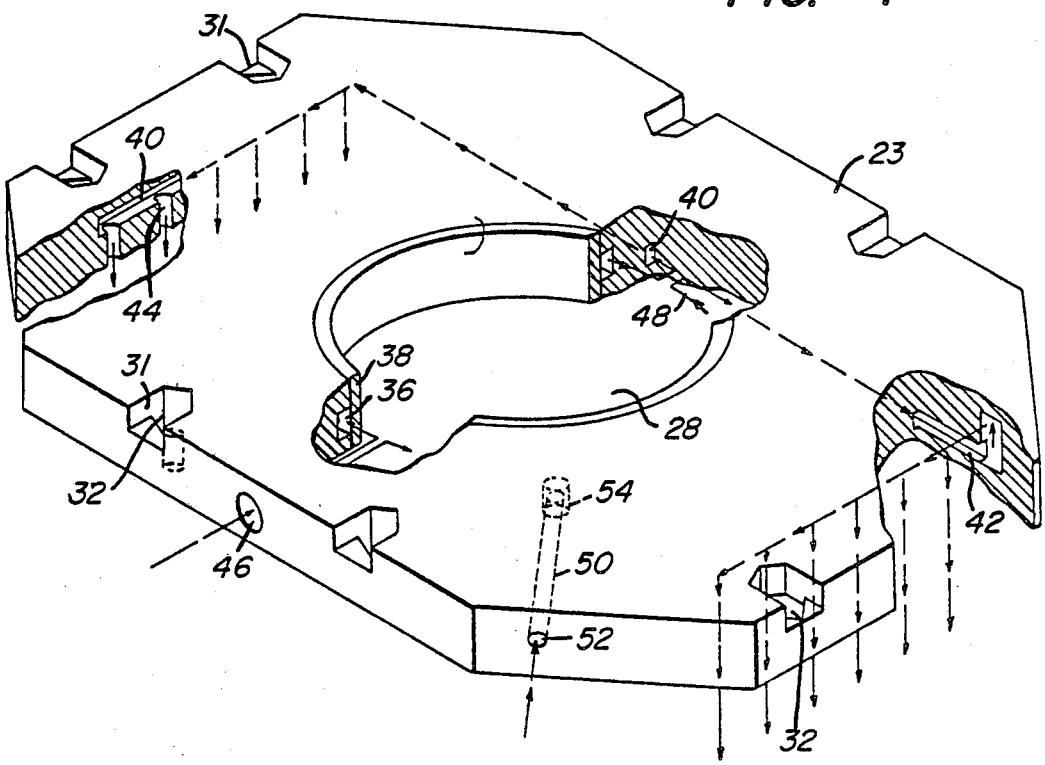
FIG. 4 is a partially broken perspective representation of the mounting plate embodied in the present invention illustrating the flow paths for cooling air and inert gas therethrough.

As best shown in FIG. 4, the mounting plate 23 is a generally flat metal plate having a central opening 28 for reception of the lower end 30 of the refractory material forming the vessel pour opening 12. The upper surface of the mounting plate 23 contains, along its side edges, recesses 31 that communicate with bolt holes 32 for reception of the connectors 18 and their associated nuts 34.

The mounting plate 23 is provided with a plurality of internal fluid passages for conducting cooling air and inert gas during periods of valve operation. A first passage 36, concentric with the central opening 28, is defined by a recess formed in the wall of the opening and covered by a ring 38 that is weldedly attached to the plate in order to seal the passage. In addition, the plate is formed with a pair of oppositely extending elongated passages 40 and 42 extending about three sides of the plate and terminating in downwardly discharging ports 44 for supplying cooling air to the valve springs as hereinafter more fully described. An air inlet port 46 is provided at one side of the plate for delivering cooling air to the fluid passages 36 & 40, 42 which, as shown by the arrows 48, are connected in series whereby cooling air is first conducted about the annular passage 36 and then in opposite directions through the passages 40, 42 before being discharged through the ports 44.

Also provided in the mounting plate 23 is an elongated passage 50 which, at one end, communicates with an inlet opening 52 at the side of the plate for connection with a source of inert gas and at the other end, with a downwardly directed discharge opening 54 adapted to communicate with gas supply means in the valve top plate 18 as hereinafter described.

Figure 8:
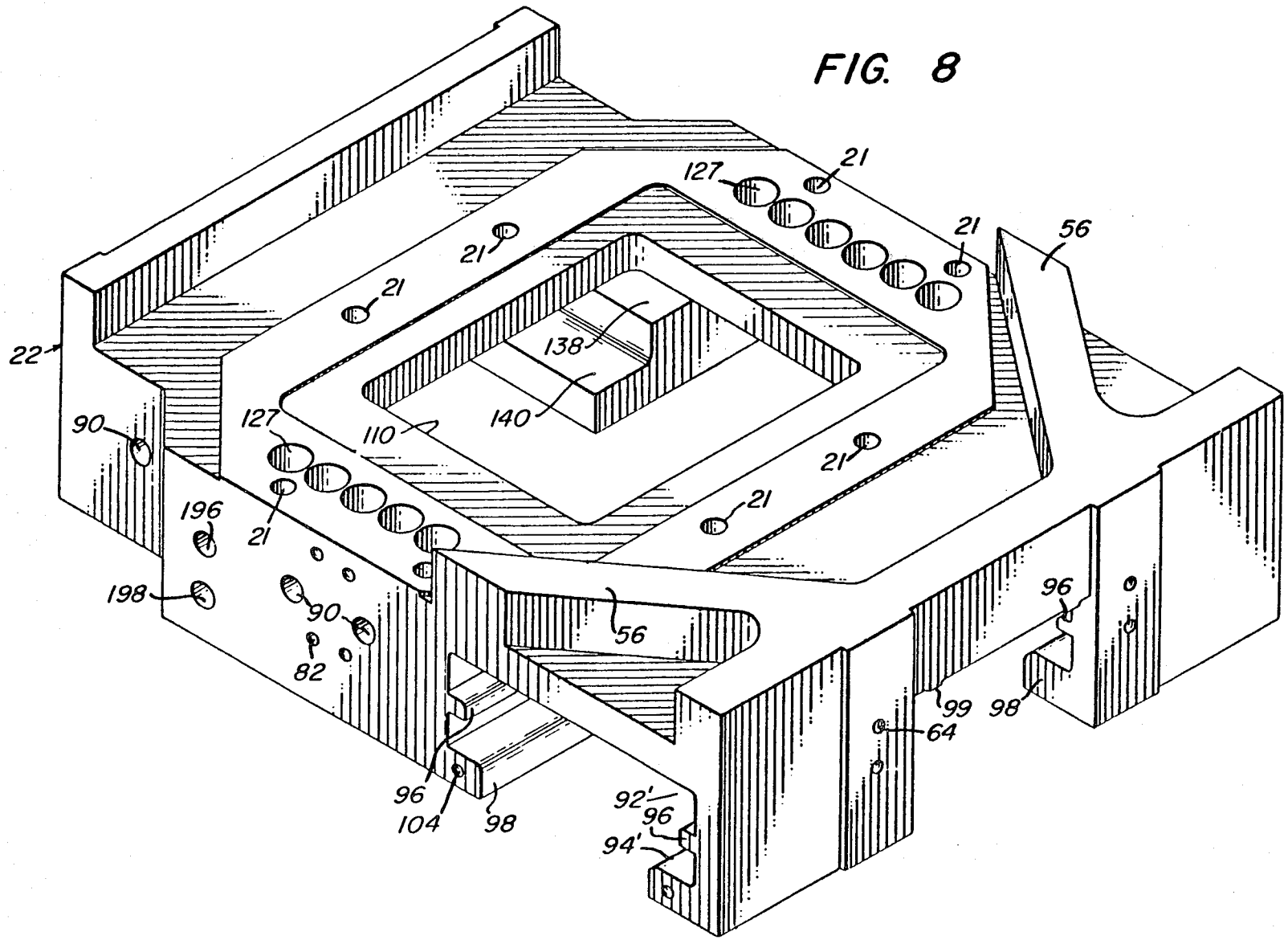
FIG. 8 is a perspective view taken from above of the valve frame structure of the present invention prior to assembly.
Figure 9:
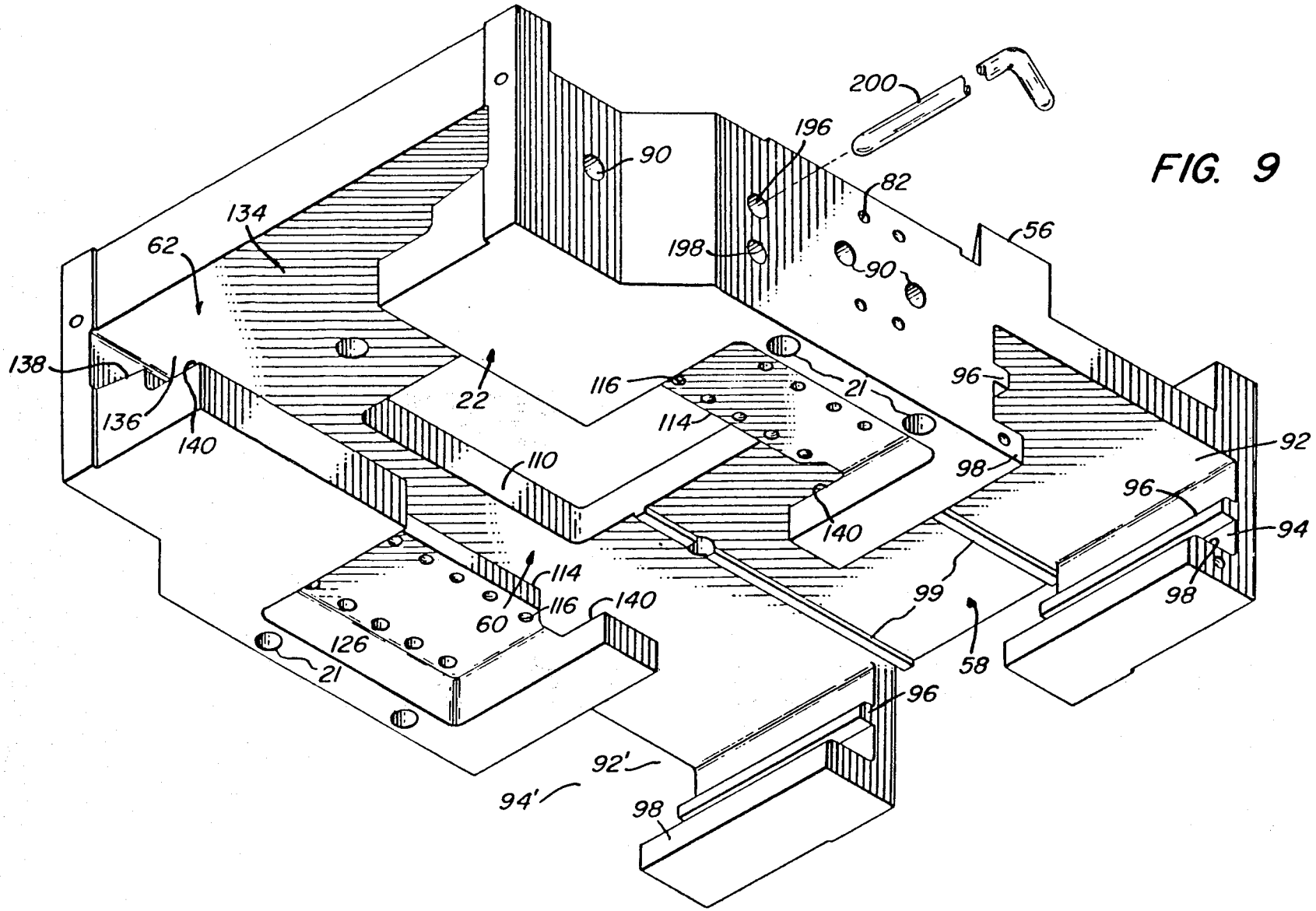
FIG. 9 is a perspective view taken from below of the valve frame structure of FIG. 8.

The valve frame 22, formed essentially of a machined metal casting stiffened by members 56 is best illustrated with particular reference to FIGS. 8 and 9. This frame 22 contains the operating parts of the valve organization and is adapted for attachment to the mounting plate 23, or release therefrom, as an assembled unit through the connectors 18. The frame 22 comprises three principle sections, indicated generally in FIG. 3 as plate loading section 58, operating section 60 and plate discharge section 62. Adjacent the plate loading section 58 the frame 22 attaches, through connectors (not shown) engageable with threaded holes 64 (FIG. 8), bracket means 66 for mounting feed motor 68. The feed motor 68 comprises a fluid operating cylinder 70 having a reciprocable piston attaching a piston rod 72 and pusher 74. A second set of motors, termed "throttling motors" are attached to the frame 22 adjacent the operating section 60 thereof. These motors 76 are oppositely acting and are operated independently of the feed motor 68. They each comprise an operating cylinder 78 mounted to the frame by bracket 80 which attaches to the frame side wall by connectors engageable with the holes 82. The cylinders 78 each contain a reciprocable piston whose rod 83 attached a laterally elongate connecting brace 86 which connects slide pins 88 that are guidingly received in openings 90 in the frame side wall and attach throttling rails 84 and 84' that operate to manipulate a slide plate disposed in the operating section 60 of the frame. Rail 84' is of a length shorter than rail 84 in order to accommodate passage of a plate through the loading section 58 of the frame.

The interior of the frame 22 is configured to define communicating paths of travel for slide plates 17 or 17' and pour tube assemblies 19 between the respective frame sections 58, 60 and 62. The loading section 58 of the frame 22 heredescribed is defined by laterally extending guideways 92 and 94 adapted to pass slide plates 17, 17' and pour tube assemblies 19 respectively. The guideway 92 is vertically spaced from guideway 94 by oppositely extending slide rails 96 that serve to support the slide plates that are loaded in the valve. The bottom of guideway 94 is defined by a similar set of slide rails 98 that support pour tubes 19 for loading. Rub rails 99 along the roof of the frame in this section serve to vertically position a slide plate 17 as it is moved from the loading section 58 of the valve to the operating section 60 thereof.

It will be appreciated that frame 22, as depicted in FIGS. 8 and 9, is adapted for slide plate or pour tube insertion from either the right or left hand side by the provision of identical guideways 92' and 94' on the opposite side of the frame. When the guideways 92 and 94 are selected for use, those guideways indicated as 92' and 94' on the opposite side of the frame are closed by a stuffer member 100 comprising a backing plate 102 threadedly connectable to the frame 22 at holes 104 (FIG. 8) and vertically spaced stop plates 106 and 108 that fill the guideways 92' and 94' effectively preventing movement of a pour tube beyond its desired position adjacent the pusher 74. Obviously, loading from the opposite side of the frame can be readily effected by simply moving the stuffer member 100 from passageways 92' and 94' to the opposite side of the frame where it will fill the passageways 92 and 94.

The operating section 60 of the frame 22 contains a rectangular opening 110 in the upper surface thereof for reception of a stationary refractory top place 18 whose central orifice 112 aligns with the pour opening 12 from the vessel and defines the inlet to the valve 10. Vertically spaced below the opening 110 the frame 22 is provided with oppositely spaced bases 114 that cooperate with the upper wall of the frame to define a cavity 115. The bases 114 are provided with laterally spaced threaded holes 116 which receive connectors 118 for mounting a series of spring biased levers 120 that operate to retain the pour tube assembly 19, slide plate 17 or 17' and top plate 18 in surface-to-surface sealed relation. The levers 120 pivot upon rockers 122 retained by the connectors 118 and are spring biased by headed push pins 124 movably mounted in holes 126 in the frame. The holes 126 are counter bored at their upper ends at 127 to provide seats for the push pin heads 128 and for springs 130 that bear between the push pin heads and the facing surface of mounting plate 23.

As shown in FIG. 2 the holes 126 in the frame 22 are caused to communicate with the ports 44 in the mounting plate 23 whereby cooling air is supplied to prevent overheating of the springs 130. Desirably, the ports 44 contain discharge orifices 132 in order to effectively distribute cooling air to the respective spring assemblies.

Opposite walls of the valve frame 22, adjacent the operating section 60, are provided with vertically spaced pairs of aligned holes, indicated as 196 and 198 respectively. Each pair of aligned holes is adapted to receive a selectively positionable stop pin 200 that traverses the respective paths of travel of the slide plate or pour tube assembly and is operative during plate changing procedures to obstruct movement of either the slide plate 17 or pour tube assembly 19 when it is desired to replace the other. Similar holes 196' are provided in rails 84 and 84' to accommodate passage of the stop pin 200 through these members. When the simultaneous replacement of both the slide plate 17 and the pour tube assembly is desired the stop pin 200 is withdrawn from the frame completely leaving both paths of travel free of obstruction. Under normal operating conditions the stop pin 200 is retained in the lower pair of holes 198 to leave the slide plate travel path free of obstruction in order to permit rapid termination of molten metal flow as hereinafter described.

The discharge section 62 of the frame 22 is formed by vertically spaced guideways 134 and 136 opening at the end of the frame. The guideways 134 and 136 are defined by stepped shoulders 138 and 140 formed in the longitudinal extensions of the bases 114 and are adapted to slidably guide the slide plates 17 or 17' and pour tube assemblies 19 respectively from their positions in the operating section 60 of the valve to a point of discharge as hereinafter described.

Figure 3:
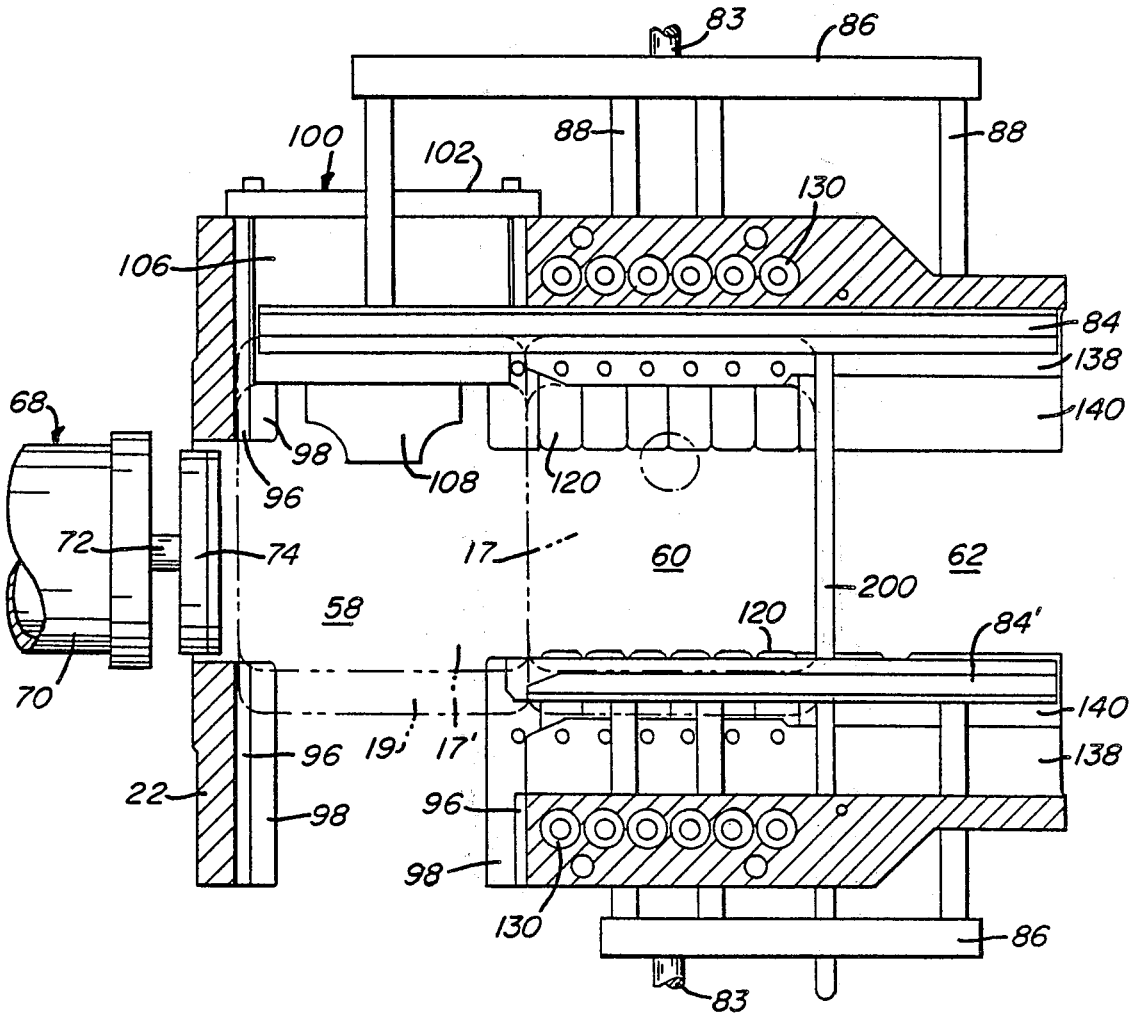
FIG. 3 is a plan sectional view taken along line 3—3 of FIG. 1.

As shown best in FIG. 3, the throttling rails 84 and 84' are disposed in the frame 22 at substantially the same elevation as slide plate loading guideway 92. Rail 84 is longer than rail 84' extending substantially the full length of the frame interior. Rail 84', on the other hand, is shorter than rail 84 by an amount to permit passage of a slide plate 17 from the guideway 92 into position with respect to pusher 74 upon loading of these members. Rail 84 is further provided along that portion of its length that faces the guideway 92 with a plurality of longitudinally spaced magnets 142 here shown as being six four-pole permanent magnets, the function of which is to prevent dislodgement of a slide plate 17 or 17' in the loaded, "ready" position, hereinafter described, from the rail 84 as it is moved during the performance of the throttling function of the valve.

The slide plates 17, 17', top plate 18 and pour tube assemblies 19 of the valve organization 10 each essentially comprise a refractory material encased in a metal frame. The pour tube assembly 19 contemplated for use in the described organization is of essentially conventional construction consisting of an elongated cylindrical tube 144 having an axial opening 145. The tube 144 is of a length to permit its lower end to extend into a caster mold, or the like, (not shown). The upper end of the tube 144 is adapted for reception into a recess 146 in the lower surface of a generally flat, rectangular refractory plate, termed the tube holder plate 148. The plate 148 contains a through-opening 149 coaxial with tube opening 145 and is enclosed about the exposed portion of its bottom and about its peripheral sides by a metal casing 150. As shown in the drawing, a mortar cement is employed to seal the joint between the upper end of the tube 144 and the holder plate 148 and to attach the holder plate within the metal enclosure. The metal enclosure may be provided with a depending skirt 152 which serves to protect the mortared joint and to stiffen the enclosure bottom surface. A heat resistant material such as asbestos rope (not shown) can be used to fill the space 153 between the skirt and the tube. A secondary attachment between the tube 144 and the holder plate can be effected by provision of a collar 154 defining a shoulder 156 adjacent the upper end of the tube for engagement by a retention ring 158 which is releasably secured to the metal casing 150 by threaded fasteners, or the like (not shown). The openings 145 in the pour tube 144 and 149 in plate 148 are preferably formed of a diameter slightly greater than that of the slide plate orifice in order to permit metal drainage from the passage upon throttling the valve to a fully closed condition.

Figure 5:
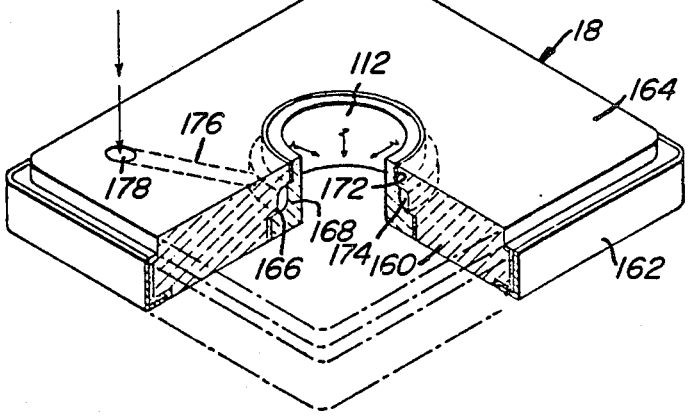
FIG. 5 is a partially broken perspective representation of a top plate embodied in the present invention.

The top plate assembly 18 of the present organization is shown in FIGS. 1, 2 and 5. The assembly 18 comprises a rectangular refractory plate 160 set by mortar in a metallic casing 162 of generally L-shaped cross section that extends about the peripheral sides of the plate. The upper surface 164 of the plate 160 extends above the upper edge of the casing and is provided with a polished finish to provide a smooth surface-to-surface contact with the lower surface of mounting plate 23 and the vessel refractory lining 14 when the assembly is in its operative position in the valve organization. Plate 160 is provided with a centrally disposed stepped through opening 166 in order to receive a permeable refractory insert 168 having an axial opening defining the molten metal flow passage 112 through the plate. The insert 168 has an exterior surface 172 that is stepped in a fashion complimentary to that of the plate opening 166 with the outermost steps being adapted for cemented engagement with the mating steps of the opening but with the intermediate step of a significantly smaller diameter than that of the intermediate step of the opening. In this way there is defined an annular passage 174 about the circumference of the insert 168 for the supply of inert gas through the insert into the metal flow passage 112. The refractory plate is provided with an oblique channel 176 that opens at the top of the plate at 178 and being positioned to communicate with the opening 54 in the lower surface of the mounting plate 23 when the valve is assembled. There is thus provided a convenient means for supplying inert gas into the metal flow passage 112 during periods when the valve is closed thereby to stir the metal in flow passage and thus prevent its freezing. By forming the annulus in this fashion, so-formed refractory top plates can be fabricated by conventional refractory forming methods without the need for expensive machining with collapsible or multi-part machine tooling.

Figure 6:
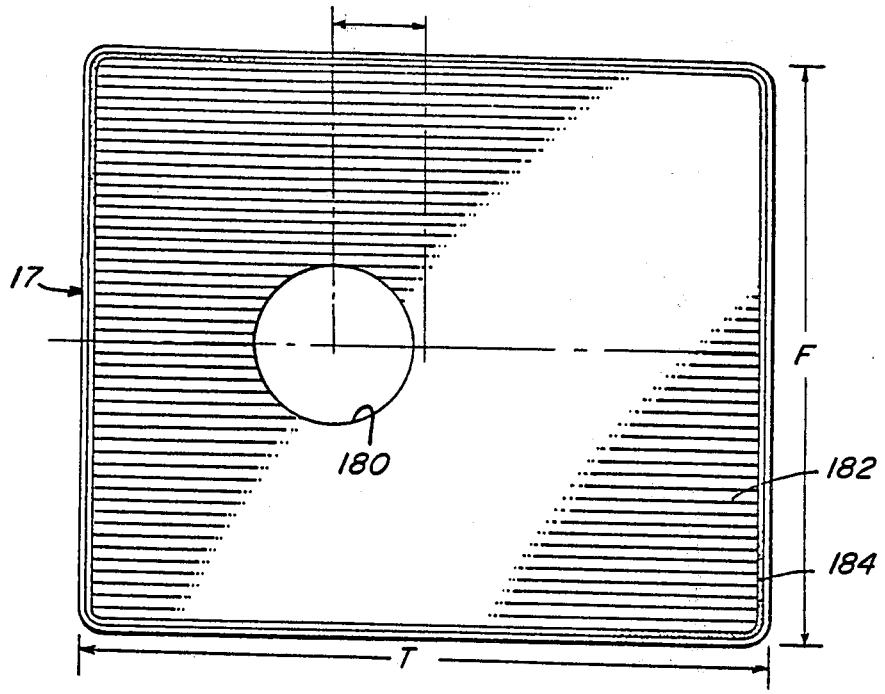
FIG. 6 is a plan view of a sliding plate constructed according to the present invention.
Figure 7:
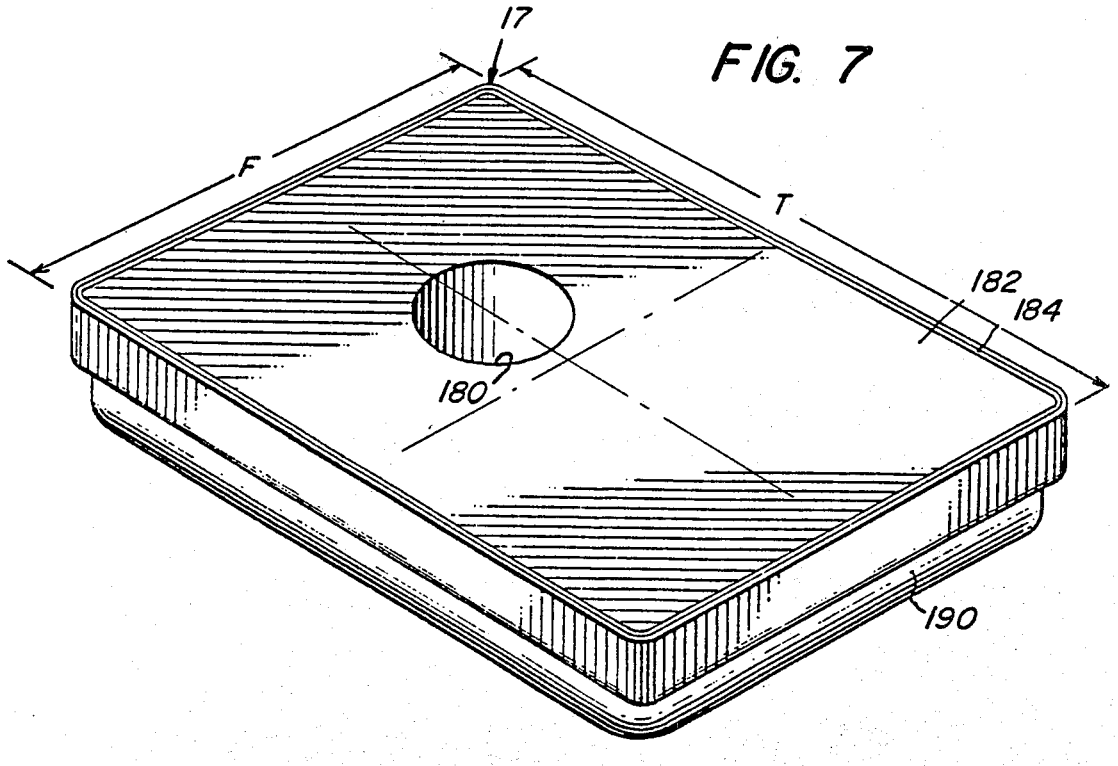
FIG. 7 is a perspective view of the sliding plate of FIG. 6.

The slide plate assemblies utilized in the valve organization may be blank or imperforate as the type shown at 17' in FIG. 1 or may contain a through opening 180 as the type shown at 17 in FIGS. 2, 6 and 7. Blank plates 17' are employed, as shown in FIG. 1, to prevent metal flow through the valve while orificed plates 17 are employed when it is desired to controllably pass molten metal through the valve as hereinafter described. Both slide plate assemblies 17 and 17' are fabricated in an identical manner comprising a generally rectangular refractory plate 182 which is slightly longer in the feed direction indicated as F in FIGS. 6 and 7 than in the throttling direction indicated as T. The plate 182 is cemented within a metal casing 184 that encloses the peripheral sides of the plate. The casing 184 is provided with a shoulder 186 intermediate its upper and lower edges for seating engagement on the throttling rails 84 and 84' and for sliding engagement upon the slide rails 96 in the loading section 58 of the valve and the shoulders 138 in the discharge section 62 thereof. The refractory plate 182 is formed at 188 with a mating shoulder conforming to that in the casing.

The lower portion of the casing, indicated as 190, is formed with an enlarged radius curvature providing a guiding surface to enable the respective slide plate assemblies when being moved by pusher 64 into the operating section 60 of the valve to be guidingly urged up and over the upper edge of the pour tube holder assembly without causing damage to either member.

The lower portion of the plate 182 adjacent the enlarged radius portion 190 of the casing is tapered as shown thus to provide an enlarged receptacle 192 for mortar between the plate and the metal casing. The enlarged mortar bed in this region of the assembly operates to cushion the plate during movement of the plate across the tube holder assembly 19 and when the plate is manipulated by the movable rails 84, 84' during periods of throttling.

Slide plate assembly 17 differs from assembly 17' in that the latter is imperforate while the former contains the molten metal flow opening 180. The position of the opening 180 in the refractory plate is critically located along the longitudinal centerline of the plate but offset from the center point of the plate toward the left in FIG. 2 by an amount equal to one-half the length of stroke of the throttling pins 88 thereby permitting the opening 180 to be vertically aligned with the top plate opening 112 for full flow of metal through the pour passage with the plate fully stroked to the right as viewed in FIG. 2 with the rail 84' in abutment with the wall 194 of the cavity 115. With the plate 17 being fully stroked to the left and the rail 84 abutting wall 196 the opening 180 is moved completely out of registry with the opening 112 thereby effecting termination of molten metal flow through the valve. By operation of the throttling motors 76 the position of the opening 180 in the plate 17 can be adjusted to any desired location with respect to the top plate opening 112 intermediate these full stroke positions thereby to alter the effective size of the molten metal flow passage through the valve for regulating molten metal flow therethrough.

A typical commercial embodiment of the slide plate assembly 17 is approximately 10.9 inches along in the feed direction F and 12.9 inches long in the throttling direction T with the center of the opening 180 having a three inch diameter being offset from the plate center point approximately 1.75 inches thereby providing about one-half inch of refractory material between the holes 112 and 180 with the plate 17 in the shutoff position.

The operation of the hereindescribed valve organization 10 is as follows:

The valve frame 22 is attached to the mounting plate 23 at the bottom of the teeming vessel 16 as shown in FIG. 1 with the top plate 18, a blank slide plate 17' and a pour tube assembly 19 preassembled in the operating section 60 of the valve frame. The flow passage 112 through the top plate 18 is thus vertically aligned with the pour passage 12 through the vessel lining 12. When molten metal is deposited in the vessel its flow through the valve is prevented due to the obstruction in the flow passage presented by the flow-impervious blank slide plate 17'. During such metal holding periods an inert gas, such as argon or nitrogen, is admitted to the pour passage 112 of the top plate through passages 52 in the mounting plate 23 and 176 in the top plate into the annulus 174 about insert 168 from whence it permeates the pourous wall of the insert to enter the passage 112. Entry of inert gas in this fashion serves to stir the molten metal in the obstructed flow passage and thereby prevents its freezing therein. Also, cooling air is admitted to the valve through inlet 46 in the mounting plate 23 from whence it flows seriatim through annular passage 36 about the lower region of the vessel lining 14 to cool the refractory material in this region and thence through passages 40, 42 to discharge from ports 44 to cool the springs 130.

With the throttling mechanism disposed to place the rails 84 and 84' in the position shown in FIG. 2 with rail 84 in abutment with cavity wall 196, an orificed slide plate 17 is inserted manually into the valve loading section 58. The slide plate 17 is inserted through the guideway 92 with the plate shoulders 186 in sliding engagement upon the slide rails 96. The slide plate 17 is moved until its leading edge surface abuts the rail 84, being retained thereagainst by the magnets 142, thus placing the slide plate 17 in its "ready" position adjacent the pusher 74 of the feed motor 68. Thereafter, the feed motor 68 is actuated to cause the pusher 74 to move the slide plate 17 from its "ready" position into the operating section 60 of the valve frame 22 between the top plate 18 and pour tube assembly 19 by displacing the blank plate 17 which slides along the shoulders 138 to the discharge section 162 from whence it exits the frame. An effective surface-to-surface seal between the respective plates is provided by the spring-biased levers 120 which urge the tube holder plate 148 upwardly against the slide plate 17 and that, in turn, upwardly against the top plate 18. Due to the presence of the enlarged radius 190 on the casing 184 of the slide plate 17 the moving plate is guided across the facing edge of the spring biased pour tube holder plate 148 without damaging that plate. The feed motor 68 is then actuated in the reverse direction to retract the pusher 74 to the position shown in FIG. 1 whereupon, for safety reasons, a blank slide plate 17', as shown in FIG. 3, is inserted into its "ready" position in the valve frame 22 in the same manner as described above in connection with the insertion of the slide plate 17.

When it is desired to initiate molten metal flow through the valve the flow of inert gas to the passage 112 is terminated and the throttling motors 76, which operate in unison, are actuated to move the rails 84, 84' and the retained slide plate 17 laterally of the cavity 115. Normally, the motors 76 will be actuated to move the rails 84, 84' to place rail 84' into abutment with wall 194 of cavity 115 thereby placing the orifice 180 of slide plate 17 in axial alignment with the opening 112 in the top plate 18. This defines the "full-open" position of the valve. Alternatively, however, it will be appreciated that, where molten metal flow is desired at a rate less than full flow, the throttling motors can be controlled to locate the slide plate 17 at any intermediate position between "full open" and "full close" to produce the desired intermediate flow rate. Furthermore, during the course of teeming the position of the slide plate can be altered, either to increase or decrease the rate of molten metal flow through the valve as desired by controlling the operation of the throttling motors 76 which impart throttling movement to the slide plate 17 and its orifice 180 with respect to the top plate pour opening 112.

The invention permits ready replacement of both the slide plate 17 and the pour tube assembly 19, either singly or jointly. When it is desired to replace a spent slide plate 17 the stop pin 200 is inserted through holes 198 in the valve frame 23 to prevent movement of the pour tube assembly. The blank plate 17' is withdrawn from the "ready" position adjacent the pusher 74 and a replacement slide plate 17 inserted in its stead. The feed motor 70 is then actuated to move the replacement plate into the operating section 60 of the valve while discharging the spent plate through the discharge opening 62.

This procedure can be accmplished with the throttling rails 84, 84' disposed in any lateral position across the operating section 60 since the replacement plate 17 is retained on the rail 84 by means of the magnets 142. Thus, when installed in the operating section 60, the replacement plate 17 will assume the same throttling position of the spent plate it replaced.

When it is desired to replace a pour tube assembly 19, the throttling rails 84, 84' are operated by the throttling motors 76 to move the slide plate 17 to the fully closed position shown in FIG. 2 and the safety blank 17' withdrawn from the valve frame. The stop pin 200 is next removed from holes 198 and inserted in holes 196, 196' to prevent movement of the operative slide plate 17. The replacement pour tube assembly 19 is then mutually inserted through guideway 94 of the loading section 58 of the valve frame 23 to a position adjacent the pusher 74 whereupon the feed motor 70 is actuated to move the replacement pour tube assembly 19 into its operative position beneath the slide plate 17 in the section 60 while expelling the spent pour tube assembly through the guideway 136 of the discharge section 62.

When, alternatively, it is desired to change both a slide plate 17 and a pour tube assembly 19, the throttling motors 76 are actuated to move rails 84, 84' and the operative slide plate 17 to the fully closed position and the stop pin 200 is withdrawn from the valve frame. The replacement slide plate 17 and pour tube assembly 19 are inserted through guideways 92 and 94 respectively in the loading section 58 to their "ready" positions adjacent the pusher 74. Upon actuation of the feed motor 68, the replacement slide plate and pour tube assembly are simultaneously moved into position into the operating section 60 while expelling their spent counterparts through guideways 134 and 136 of the discharge section 62.

An important characteristic of the hereindescribed valve organization is the ability to rapidly terminate molten metal flow through the valve and independently of its throttling function. This characteristic is achieved by virtue of the fact that the operation of the feed motor 68 which effects plate replacement in the valve is totally independent from that of the throttling motors 76 and that slide plates 17 can be changed regardless of the throttling position of the operative slide plate located in valve section 60. Thus, during the course of normal valve operation a blank slide plate 17' is preferably retained in the "ready" position adjacent pusher 74. This plate, like all plates in the "ready" position, is secured to the rail 84 by the magnets 142 and thus is caused to move laterally back and forth with the operative slide plate 17 thereby insuring that the former is always longitudinally aligned with the latter. If for any reason it becomes necessary to rapidly terminate the flow of molten metal, as for example, due to malfunction of the casting process, the feed motor 68 need only be actuated to replace the operative orificed slide gate 17 with the blank gate 17'. The advantage of this feature can be appreciated when it is considered that a plate change can be effected by the feed motor in less than 0.2 second as contrasted with a period of approximately 2 seconds duration that is required to move the operative slide plate from its fully open position to its fully closed position by the throttling motors 76.

Figures 10, 12, 13:
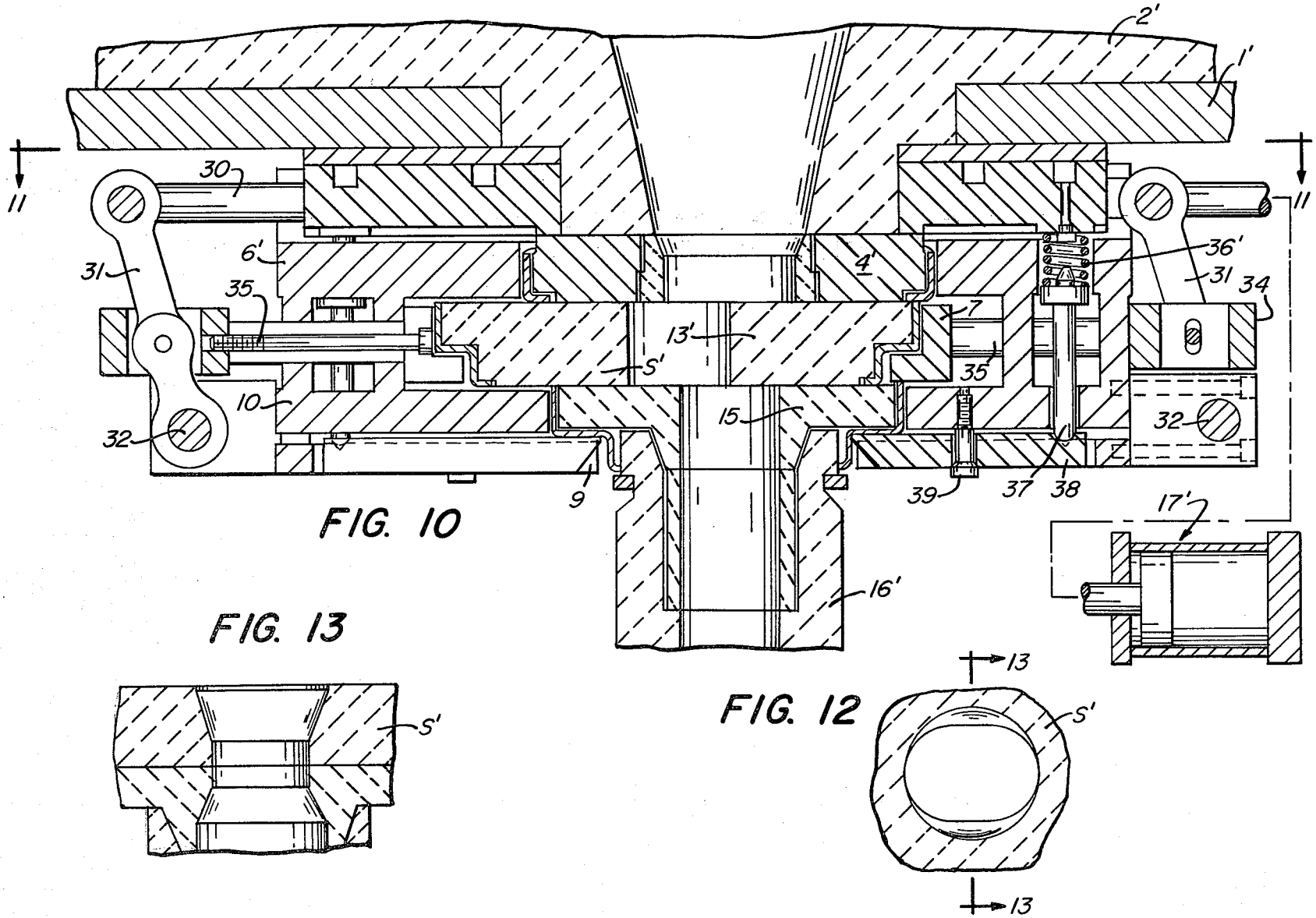
FIG. 10 is a plan view of a slightly modified embodiment of the invention.
FIG. 12 is a plan sectional view of the orifice opening through the slide plate in the embodiment of FIG. 10.
FIG. 13 is a vertical sectional view taken along line 13—13 of FIG. 12.
Figure 11:
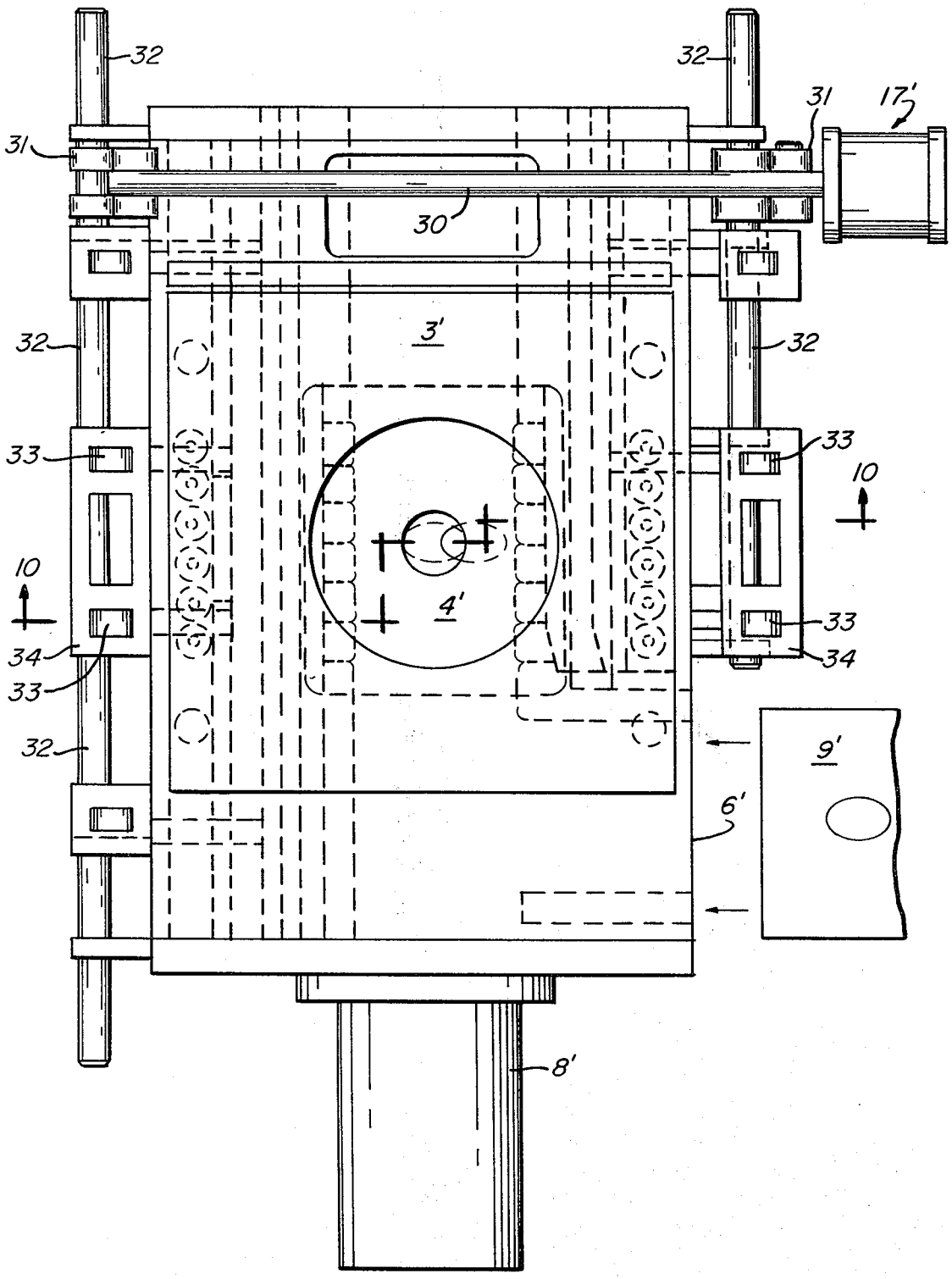
FIG. 11 is a vertical sectional view taken along line 11—11 of FIG. 10.

In FIGS. 10 and 11 there is illustrated an alternative, although slightly less desirable, embodiment of the invention in which parts similar to those employed in the preferred embodiment are indicated by the same numerical designation but with a superposed prime. This valve arrangement which represents an earlier valve form improved upon by the hereinabove described perferred embodiment of the invention has substantially the same operating characteristics of the preferred embodiment but employs a different throttling motor arrangement and is characterized by restricted slide plate movement in the throttle direction preventing complete closure of the valve flow passage except by means of replacement of the orificed plate with a blank plate.

As shown, the valve frame 22' mounts a throttling motor organization, indicated generally as 76', that is operative to move the throttling rails 84' containing orificed slide plate 17' with respect to the opening 112' in the top plate 18'. The throttling motor organization 76' includes a single operating cylinder 78' fixedly secured with respect to the frame 22'. The piston 202 operative in cylinder 78' is operatively connected to a cross link 204 that extends transversely across the valve frame 22' through an opening (not shown) in the mounting plate 23'. The cross link 204 is operative to oscillatably drive a pair of crank shafts 206 journalled each in bearing brackets 208 that are mutually spacedly disposed on opposite sides of the frame 22'. The crank shafts 206 are driven by a pair of bell cranks 210 connected each at one end to the cross link 204 by pins 212 and fixedly secured at their other ends to the respective crank shafts. The crank shafts 206 impart movement to the respective slide plate support rails 84' through crank arms 214 that connect the crank shafts 206 to each of a plurality of yokes 216, each of which is disposed at the outboard end of each of the respective slide pins 88' to which the rails 84' are secured. An elongated slot 218 in each yoke 216 receives a pin 220 fixed to the respective crank arms 214 to impart linear movement to the respective yokes 216 while the crank arms oscillate.

It will be appreciated that the orifice opening 180' in the illustrated slide plate 17' is centrally disposed thereby limiting the extent of its movement with respect to the opening 112 in top plate 18 at the full stroke position of the throttling motor 76' and slide plate 17' thereby limiting the flow restriction in the metal flow passage to one that is less than full throttle or complete closure of the passage.

As illustrated best in FIGS. 12 and 13 the orifice opening 180' in the slide plate 17' may be of a compound shape, being circular at its upper end 222 for registry with the circular opening 112 in top plate 18 and at the bottom end 224 elongated in the direction of travel of the plate in the flow throttling direction. The opening 180' at the bottom end 224 is, as shown in FIG. 12, shaped as a straight sided member whose ends are circular. Alternatively, the opening at the bottom end 224 may be elliptical. The major axis of the elongated portion of the opening 180' has a length corresponding to the diameter of the opening at the upper end 222 of the plate. The wall of the opening 180' between the upper and lower ends of the slide plate 17' is downwardly constricted, as at 226, to produce a smooth transition in the shape of the flow stream in order to minimize the creation of turbulence therein. As is evident in the figures, especially FIGS. 10 and 13, the pour tube support plate 148' is provided with an opening 149' that corresponds in shape to the elongated opening at the lower end 224 of the slide plate 17'.

The described configuration of the slide plate opening 180' is desirable to maximize the effectiveness of the opening at the termination of the pouring effort and, conversely, to permit a relatively small total opening when teeming through a plate is initiated. With reference to FIG. 10 it will be observed that the described opening configuration in the slide plate and pour tube support plate will cooperate to produce a flow stream whose cross section closely approximates a circular shape when the slide plate is in the full stroke position, but as the orifice is opened by movement of the plate in the throttle direction in response to the buildup of deposits as would otherwise tend to clog the metal flow passage the flow passage assumes a cross sectional shape similar to that illustrated in FIG. 12, obstructed only to the extent to which clogging has occurred. The result is that a more compact flow stream can be produced over the full throttle range of the valve with a concomitant reduction in the degree of diffusion of the flow stream exiting the discharge end of the valve apparatus.

It will be appreciated that the described valve organizations have particular utility in varying the effective flow area through the valve in response to clogging or erosion of metal pour passage thereby to effectively control the flow of metal from the teeming vessel. Thus, when a metal, such as aluminum-killed steel, having a high propensity for clogging the metal pour passage is poured, the slide plate, after being placed in its operative position in the valve by operation of the plate feed motor, is adjusted by operation of the throttling motor or motors to a position creating a restricted flow passage through the valve, the cross sectional area of which corresponds to that capable of producing the intended controlled flow rate. Thereafter, as clogging occurs, the flow passage is progressively opened by operation of the throttling motors to maintain desired flow rate. When clogging progresses to the extent that the desired metal flow rate can no longer be maintained the spent slide plate is replaced by a fresh plate by operation of the plate feed motor and teeming proceeds.

Conversely, when a metal having erosive characteristics is teemed, the slide plate is initially placed in a position in which its orifice opening is substantially aligned with that of the vessel pour opening. Thereafter, as the passage-defining material erodes tending to enlarge the flow passage the side plate is moved by operation of the throttling motor or motors to constrict the flow passage and thereby maintain the desired flow rate.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. Valve apparatus for controlling the flow of liquid from the pour opening of a teeming vessel, comprising:

(a) a frame for connection to said vessel:

(b) gate supporting means extending longitudinally through said frame for slidably supporting blank and orificed refractory gates for movement along a first path of travel between a loading section adjacent one frame end, an operating section subjacent said vessel pour opening, and a gate discharge section adjacent the other frame end;

(c) first moving means for moving said gates sequentially along said gate supporting means between said frame sections; and (d) second moving means operable independently of said first moving means and operative to move an orificed gate disposed in said operating section of said frame with its orifice in registry with said vessel opening along a second path of travel to vary the degree of registry of the gate orifice with respect to said vessel opening between a position of coaxial alignment therewith and a position out of registry therewith.

2. Apparatus according to claim 1 in which said second moving means is operatively connected to said gate supporting means for moving the same laterally of said first path of travel.

3. Apparatus according to claim 2 in which said gate supporting means comprise oppositely spaced rails engageable with the gates and mounted in said frame for movement laterally of said first path of travel.

4. Apparatus according to claim 3 in which at least one of said rails is coextensive with said frame sections and including means on said at least one rail for retaining a gate thereon in the loading section of said frame.

5. Appratus according to claim 4 in which said gate retaining means comprises magnet means mounted in said at least one rail.

6. Apparatus according to any one of claims 1 through 5 including pour tube supporting means subjacent to and substantially coextensive with said gate supporting means, said pour tube supporting means being operative to mount a pour tube assembly in operative relation with respect to a gate in the operating section of said frame and to slidably support the same along a path of travel parallel with said first path of travel.

7. Apparatus according to claim 6 in which said first gate means includes means for moving a pour tube assembly along said pour tube supporting means.

8. Apparatus according to claim 7 including means operative in said frame for selectively obstructing movement of said gates and pour tube assembly whereby said first gate moving means is operative to move said gates and pour tube assemblies singly or jointly.

9. Apparatus according to claim 8 in which said obstructing means comprises a stop pin selectively positionable in a position traversing the path of travel of the gates or one traversing the path of travel of the pour tube assemblies.

10. Valve apparatus for controlling the flow of liquid from the pour opening of a teeming vessel, comprising:

(a) a frame having rectangularly disposed end and side walls for connection to said vessel;

(b) opposed gate supporting rails extending through said frame for slidably supporting blank and orificed refractory gates for movement longitudinally through said frame between a loading section adjacent one frame end, an operating section subjacent said vessel pour opening and a gate discharge section adjacent the other frame end, said rails being movably mounted in opposed side walls of said frame for transverse reciprocable movement therein;

(c) first moving means including a fluid cylinder attached to said frame at said one end and having a piston attaching a ram adapted for operation in the leading section to move gates along said rails in sequence between the respective frame sections;

(d) second moving means including fluid cylinders attached to said frame and each having a piston operably connected to each of said gate supporting rails for imparting conjoint transverse movement thereto; and (e) said first moving means and said second moving means being independently operable.

11. Apparatus according to claim 10 including means defining an opening in one of said frame side walls communicating with the frame loading section for lateral insertion of said gates.

12. Apparatus according to claim 11 in which one gate supporting rail in facing relation to said opening is coextensive with said frame loading, operating and gate discharge sections and the other gate supporting rail is foreshortened adjacent said opening to accommodate passage of gates.

13. Apparatus according to claim 12 including magnet means in said one gate supporting rail opposite said opening and operative to retain a gate thereon.

14. Apparatus according to claim 10 including pour tube supporting rails in said frame disposed subjacent to and being substantially coextensive with said gate supporting rails.

15. Apparatus according to claim 14 including means defining an opening in one of said frame side walls communicating with the frame loading section for lateral insertion of pour tube assemblies.

16. Apparatus according to claim 14 in which said pour tube supporting rails, at least in the operating section of said frame, comprise spring-biased levers.

17. Apparatus according to claim 14 including a stop pin, and means in said frame side walls to accommodate selective positioning of said stop pin transversely of said gate supporting rails or said pour tube supporting rails.

18. Valve apparatus for controlling the flow of liquid from the pour opening of a teeming vessel, comprising (a) a frame connected to said vessel having rectangularly disposed end and side walls defining a hollow interior forming a first path of travel having longitudinally spaced loading, operating and gate discharge sections therein;

(b) a top plate fixedly mounted in the operating section of said frame and having a throughopening in fluid communication with said vessel pour opening;

(c) opposed gate supporting rails mounted for transverse movement in said frame for slidably supporting refractory gates for sequential movement through said frame sections;

(d) at least one refractory gate slidably mounted on said gate supporting rails in the operating section of said frame, said gate containing an orifice for registry with said top plate opening;

(e) first moving means attached to said frame and operative to move refractory gates along said gate supporting means between said frame sections; and (f) second moving means operable independent of said first moving means operatively connected to said rails to move said gate along a second path of travel transversely of said frame to vary the degree of registry of said gate orifice with said top plate opening between a position of coaxial alignment therewith and a position out of registry therewith.

19. Apparatus according to claim 18 in which said refractory gate comprises:

(a) a generally rectangular body having a longitudinal axis parallel to said first path of travel and a lateral axis parallel to said second path of travel; and (b) a through opening through said body defining said orifice disposed on said lateral axis in offset relation to said longitudinal axis.

20. Apparatus according to claim 19 in which the amount of said offset corresponds to substantially one-half the extent of movement of said rails along said second path of travel.

21. Apparatus according to claim 20 in which the opposed faces of said frame side walls define limit stops of said rails along said second path of travel.

22. Apparatus according to claim 18 including:

(a) pour tube supporting rails disposed in said frame subjacent to, and substantially coextensive with said gate supporting rails; and (b) a pour tube assembly on said rails having a tube support plate engageable therewith for sliding movement therealong and an orifice opening therethrough for communication with said gate orifice.

23. Apparatus according to claim 22 in which said first moving means contains means operative to move said pour tube assembly along said rails and including a stop pin cooperable with said frame for selectively obstructing movement of said gate and said pour tube assembly along their respective support rails.

24. Apparatus according to claim 22 including means on said frame for biasing said pour tube support plate into sealing relation with said gate.

25. Apparatus according to claim 24 in which said biasing means comprise:

(a) levers pivotally attached to said frame and having one end engageable with said pour tube support plate; and (b) means including springs in said frame to provide an upward bias to said one end of each of said levers.

26. Apparatus according to claim 25 including cam surface means on said gate engageable with said pour tube support plate for locating said gate with respect thereto during periods of relative movement therebetween.

27. Apparatus according to claim 25 including a valve mounting plate interposed between said frame and said vessel for effecting the connection therebetween, means forming ports in said frame in overlying relation to said springs and means for supplying cooling fluid to said ports.

28. Apparatus according to claim 25 in which said valve mounting plate contains:

(a) an axial opening concentrically disposed about said vessel pour opening;

(b) an annular passage concentrically spaced from said axial opening; and (c) means for passing cooling air seriatim to said annular passage and said ports.

29. Apparatus according to claim 18 including means on said frame for biasing said gate into sealing relation with said top plate.

30. Apparatus according to claim 18 in which said top plate includes an annular passage concentrically disposed with respect to said through opening; and means for supplying an inert gas to said passage.

31. Apparatus according to claim 18 including a valve mounting plate interposed between said frame and said vessel for effecting the connection therebetween, said mounting plate containing:

(a) an axial opening concentrically disposed about said vessel pour opening;

(b) an annular passage concentrically spaced from said axial opening; and (c) means for supplying cooling fluid to said passage.

32. In a valve apparatus for controlling the flow of liquid from the pour opening of a teeming vessel said valve having a sliding gate containing an orifice operably positioned with respect to the pour opening, a pour tube assembly on the discharge side of said sliding gate, first drive means for moving sliding gates and pour tube assemblies into their respective operative positions, and second drive means independent of said first drive means for adjusting the degree of registry of the slide gate orifice with respect to the vessel pour opening, a method of changing pour tube assemblies comprising the steps of:

(a) positioning a replacement pour tube assembly in side by side relation with that in the operative position;

(b) moving the slide gate along a first path of travel to a position out of registry with the vessel pour opening;

(c) obstructing the slide gate against movement;

(d) displacing the spent pour tube assembly along a second path of travel out of its operative position;

(e) moving the replacement pour tube assembly along said second path of travel into its operative position; and (f) returing the slide gate along said first path of travel to a position in registry with the vessel pour opening.

33. The method according to claim 32 in which the two pour tube assemblies are moved simultaneously.

34. The method according to claim 33 in which the spent pour tube assembly is displaced by movement of the replacement pour tube assembly into its operative position.

35. In a valve apparatus for controlling the flow of liquid from the pour opening of a teeming vessel said valve having a sliding gate containing an orifice operably positioned with respect to the pour opening, a pour tube assembly on the discharge side of said sliding gate, first drive means for moving sliding gates and pour tube assemblies into their respective operative positions, and second drive means for adjusting the degree of registry of the slide gate orifice with respect to the vessel pour opening, a method of changing slide gates comprising the steps of:

(a) positioning a replacement slide gate in side-by-side relation along a first path of travel with that in the operative position;

(b) adjusting the replacement slide gate along a second path of travel in unison with adjustment of the operative slide gate to maintain the two slide gates in mutual alignment irrespective of the adjusted position of the operative slide gate with respect to the vessel pour opening;

(c) obstructing the pour tube assembly against movement;

(d) displacing the spent gate along said first path of travel out of the operative position; and (e) moving the replacement gate along said first path of travel into the operative position.

36. The method according to claim 35 in which the two slide gates are moved simultaneously.

37. The method according to claim 36 in which the operative gate is displaced by movement of the replacement gate.

38. A sliding gate valve having independent means for throttling a stream of metal during teeming comprising, a sliding gate valve frame at the lower portion of the teeming vessel, a top plate positioned between the vessel having an orifice in open communication with a teeming opening in the bottom of the vessel, a slide gate having a teeming opening positioned beneath said top plate, means for holding the sliding gate in fluid tight relationship with the top plate, means for moving said sliding gate into and out of a teeming position and means in addition to and independent of the means for moving said sliding gate into and out of teeming position for misaligning the sliding gate from its full flow position, whereby the teeming stream may be throttled.

39. In the valve of claim 38, said slide gate teeming opening being elongated along an axis coincident with axis of misalignment and throttling.

40. In the method of claim 39, using magnetic attraction to guide the replacement sliding gate.

41. In the valve of claim 39, yieldable means for holding the slide gate against the top plate.

42. In the valve of claim 39 above, in which said means for misalignment comprise, a throttling cylinder coupled by means of a bell crank to a crank shaft, a yoke positioned along the crank shaft, and opposed push rods coupled to said yoke for engaging a slide plate and moving the same laterally.

43. In the valve of claim 38, yieldable means for holding the slide gate against the top plate.

44. In the valve of claim 43 above, in which said means for misalignment comprise, a throttling cylinder coupled by means of a bell crank to a crank shaft,
a yoke positioned along the crank shaft, and
opposed push rods coupled to said yoke for engaging a slide plate and moving the same laterally.

45. In the valve of claim 38 above, in which said means for misalignment comprise,
a throttling cylinder coupled by means of a bell crank to a crank shaft,
a yoke positioned along the crank shaft, and
opposed push rods coupled to said yoke for engaging a slide plate and moving the same laterally.

46. In the valve of claim 38 above, said means for moving said slide gate into and out of a teeming position imparting a reciprocating motion to the slide gate.

47. In the method of claim 38, guiding a replacement sliding gate to enter the valve at said sliding gate's extent of throttle.

48. A sliding gate valve for throttling of metal while being teemed comprising,
a sliding gate valve frame at the lower portion of the teeming vessel,
a top plate positioned beneath the vessel having an orifice in open communication with a teeming opening in the bottom of the vessel,
a slide gate having a teeming opening positioned beneath said top plate,
a member having a teeming orifice positioned beneath the slide gate in substantially fixed orientation with regard to the teeming openings of the top plate and vessel,
means for holding the said member against the sliding gate in fluid tight relationship,
means for moving said slide gate into and out of a teeming position, and
means in addition to and independent of the means for moving said sliding gate into and out of the teeming position for misaligning the sliding gate from its full flow position, whereby the teeming stream may be throttled.

49. In the valve of claim 48, said slide gate teeming opening being elongated along an axis coincident with axis of misalignment and throttling.

50. In the valve of claim 49, yieldable means for holding the slide gate against the top plate.

51. In the valve of claim 50 above, in which said means for misalignment comprise,
a throttling cylinder coupled by means of a bell crank to a crank shaft,
a yoke positioned along the crank shaft, and
opposed push rods coupled to said yoke for engaging a slide plate and moving the same laterally.

52. In the valve of claim 49, yieldable means for holding said member beneath the slide gate.

53. In the valve of claim 52, yieldable means for holding said member beneath the slide gate.

54. In the valve of claim 49 above, in which said means for misalignment comprise,
a throttling cylinder coupled by means of a bell crank to a crank shaft,
a yoke positioned along the crank shaft, and
opposed push rods coupled to said yoke for engaging a slide plate and moving the same laterally.

55. In the valve of claim 48, yieldable means for holding the slide gate against the top plate.

56. In the valve of claim 55 above, in which said means for misalignment comprise,
a throttling cylinder coupled by means of a bell crank to a crank shaft,
a yoke positioned along the crank shaft, and
opposed push rods coupled to said yoke for engaging a slide plate and moving the same laterally.

57. In the valve of claim 48, yieldable means for holding said member beneath the slide gate.

58. In the valve of claim 57 above, in which said means for misalignment comprise,
a throttling cylinder coupled by means of a bell crank to a crank shaft,
a yoke positioned along the crank shaft, and
opposed push rods coupled to said yoke for engaging a slide plate and moving the same laterally.

59. In the valve of claim 48 above, in which said means for misalignment comprise,
a throttling cylinder coupled by means of a bell crank to a crank shaft,
a yoke positioned along the crank shaft, and
opposed push rods coupled to said yoke for engaging a slide plate and moving the same laterally.

60. In the valve of claim 48 above, said means for moving said slide gate into and out of a teeming position imparting a reciprocating motion to the slide gate.

61. A sliding gate valve for throttling of metal while being teemed comprising,
a sliding gate valve frame at the lower portion of the teeming vessel,
a top plate positioned beneath the vessel having an orifice in open communication with a teeming opening in the bottom of the vessel,
a slide gate having a teeming opening positioned beneath said top plate,
a member having a teeming orifice positioned beneath the slide gate in substantially fixed orientation with regard to the teeming opening of the slide gate,
means for holding the said member against the sliding gate in fluid tight relationship,
means for moving said slide gate into and out teeming position, and
means independent of and in addition to the means for moving for misaligning the sliding gate and said member from their full flow position, whereby the teeming stream may be throttled.

62. In the valve of claim 61, said slide gate teeming opening being elongated along an axis coincident with the axis of misalignment and throttling.

63. In the valve of claim 62, yieldable means for holding the slide gate against the top plate.

64. In the valve of claim 62, yieldable means for holding said member beneath the slide gate.

65. In the valve of claim 64, yieldable means for holding said member beneath the slide gate.

66. In the valve of claim 65 above, in which said means for misalignment comprise,
a throttling cylinder coupled by means of a bell crank to a crank shaft,
a yoke positioned along the crank shaft, and
opposed push rods coupled to said yoke for engaging a slide plate and moving the same laterally.

67. In the valve of claim 61, yieldable means for holding the slide gate against the top plate.

68. In the valve of claim 67 above, in which said means for misalignment comprise,
a throttling cylinder coupled by means of a bell crank to a crank shaft,
a yoke positioned along the crank shaft, and opposed push rods coupled to said yoke for engaging a slide plate and moving the same laterally.

69. In the valve of claim 61, yieldable means for holding said member beneath the slide gate.

70. In the valve of claim 61 above, in which said means for misalignment comprise, a throttling cylinder coupled by means of a bell crank to a crank shaft, a yoke positioned along the crank shaft, and opposed push rods coupled to said yoke for engaging a slide plate and moving the same laterally.

71. In the valve of claim 61, above, said means for moving said slide gate into and out of a teeming position imparting a reciprocating motion to the slide gate.

72. A sliding gate valve for throttling of metal while being teemed from a vessel comprising, a top plate positioned beneath the vessel having an orifice in open communication with a teeming opening in the bottom of the vessel, a sliding gate valve frame at the lower portion of the teeming vessel arranged to support and guide a slide gate, slide gates perforate with teeming openings, and imperforate, without teeming openings, arranged in the sliding gate frame for sequential positioning beneath the top plate orifice and teeming opening in the bottom of vessel, means for sequentially positioning the slide gates beneath the top plate orifice and vessel teeming opening, means in addition to and independent of the means for sequential positioning said slide gates for misaligning the slide gates from their full flow position, whereby the teeming stream may be throttled.

73. In the valve of claim 72 above, said perforate slide gate teeming opening being elongated along an axis coincident with axis of misalignment and throttling.

74. In the valve of claim 73 yieldable means for holding said member beneath the slide gate.

75. In the valve of claim 74 above, in which said means in addition comprise, a throttling cylinder coupled by means of a bell crank to a crank shaft, a yoke positioned along the crank shaft, and opposed push rods coupled to said yoke for engaging a slide plate and moving the same laterally.

76. In the valve of claim 73 above, in which said means in addition comprise, a throttling cylinder coupled by means of a bell crank to a crank shaft, a yoke positioned along the crank shaft, and opposed push rods coupled to said yoke for engaging a slide plate and moving the same laterally.

77. In the valve of claim 72, yieldable means for holding said member beneath the slide gate.

78. In the valve of claim 77 above, in which said means in addition comprise, a throttling cylinder coupled by means of a bell crank to a crank shaft, a yoke positioned along the crank shaft, and opposed push rods coupled to said yoke for engaging a slide plate and moving the same laterally.

79. In the valve of claim 72 above, in which said means in addition comprise, a throttling cylinder coupled by means of a bell crank to a crank shaft, a yoke positioned along the crank shaft, and opposed push rods coupled to said yoke for engaging a slide plate and moving the same laterally.

80. A method of teeming a molten material comprising the steps of, providing a molten material container such as a ladle or a tundish at its lower portion with a lower sliding surface, said surface having a central teeming opening, positioning a sliding gate beneath the lower surface, moving the sliding gate beneath the lower sliding surface with actuating means to a normally open position, throttling the stream in the open position by displacing the sliding gate with means independent and different from the actuating means for moving from the normally closed to the normally open positions and from the normally open to the normally closed positions.

81. In the method of claim 80, providing an elongate orifice in the sliding gate which is positioned with its long axis coincident with the axis of throttling movement.

82. In the method of claim 81, compensating for teeming clogging by positioning the sliding gate initially in the most closed configuration due to maximum throttling displacement, and thereafter progressively opening the orifice as teeming clogging takes place in the orifice and/or teeming opening until such time as it is necessary to remove the sliding gate for cleaning and lancing any orifices or openings.

83. In the method of claim 82, positioning the imperforate plate into the assembly at such time as clogging has proceeded in said orifice and/or opening to an undesirable point whereupon the tube or lower pour confining member may be replaced, the top plant lanced, and another sliding gate inserted for further pouring.

84. In the method of claim 81, providing an orifice in said sliding gate, positioning the slding gate initially in the most open configuration due to alignment with central vertical axis of the stationary lower sliding surface teeming opening and thereafter progressively closing the orifice as erosion of the orifice and/or teeming opening takes place until such time as it is necessary to replace the sliding gate.

85. In the method of claim 81, positioning the sliding gate initially at a position providing an opening intermediate to its fully open and fully throttled positions and thereafter shifting it to a more open or more closed position in order to adjust the rate of teeming from the vessel.

86. In the method of claim 81, continuing to pour until clogging of the opening occurs, positioning an imperforate plate into the assembly at such time as clogging has proceeded to an undesirable point whereupon the tube or lower pour confining member may be replaced, the top plate lanced, and another sliding gate inserted for further pouring.

87. In the method of claim 80, compensating for teeming clogging by providing the sliding gate with an orifice, positioning the sliding gate initially in the most closed configuration due to maximum throttling displacement of said sliding gate orifice, and thereafter progressively shifting the orifice toward alignment with said central teeming opening as teeming clogging takes place until such time as it is necessary to remove the sliding gate for cleaning.

88. In the method of claim 87, positioning an imperforate plate into the assembly at such time as clogging of said orifice and/or opening has proceeded to an undesirable point whereupon the tube or lower pour confining member may be replaced, the top plate lanced, and another sliding gate inserted for further pouring.

89. In the method of claim 80, providing an orifice in said sliding gate, compensating for erosion by positioning the sliding gate initially in the most open configuration due to alignment with the central vertical axis of the stationary lower sliding surface teeming opening and thereafter progressively closing the orifice as erosion of the orifice and/or teeming opening takes place until such time as it is necessary to replace the sliding gate.

90. In the method of claim 80, positioning the sliding gate initially at a position providing an opening intermediate to its fully open and fully throttled positions and thereafter shifting it to a more open or more closed position in order to adjust the rate of teeming from the vessel.

91. In the method of claim 80, continuing to pour until clogging of the opening occurs, positioning an imperforate plate into the assembly at such time as clogging as proceeded to an undesirable point whereupon the tube or lower stream confining member may be replaced, the top plate lanced, and another sliding gate inserted for further pouring.

92. A method of teeming a molten material comprising the steps of:

providing a molten metal container such as a ladle or tundish with a means at its lower portion to have a lower sliding surface, having a teeming opening in communication with the teeming opening of the vessel, positioning a reciprocating sliding gate having a central teeming opening beneath said lower sliding surface, providing a means for moving the sliding gate so that its teeming opening moves into and out of a position normally aligned with the teeming openings of the lower sliding surface and the vessel, and providing a means for moving the sliding gate so that its teeming opening moves into and out of a position normally aligned with the teeming openings of the lower sliding surface and vessel, and, providing a means independent of the means for moving the sliding gate into and out of a position of normal alignment for displacing the teeming opening of the sliding gate at its normal aligned position so that it is partially closed in the normally aligned position, whereby throttling of the stream occurs without interfering with the ability to open and close.

93. A sliding gate valve for throttling of metal while being teemed from a vessel comprising, a top plate positioned beneath the vessel having an orifice in open communication with a teeming opening in the bottom of the vessel, a sliding gate frame at the lower portion of the teeming vessel arranged to support and guide slide gates, a collector member below the slide gates, slide gates, perforate with teeming openings, and imperforate without teeming openings, arranged in the sliding gate frame so that they may be sequentially positioned beneath the top plate orifice and teeming opening in the bottom of the vessel, said collector member having a teeming orifice positioned beneath the slide gate in substantially fixed orientation with regard to the teeming openings of the top plate and vessel, means for holding said collector member in fluid tight relationship to the slide gate and for holding said slide gate in fluid tight relationship to the top plate, means for sequentially positioning the slide gates beneath the top plate orifice and above the collector member orifice, means in addition to and independent of the means for sequential positioning slide gates for misaligning the slide gates along a path of misalignment from their full flow position, whereby the teeming stream may be throttled.

94. In the valve of claim 93, an elongate orifice in the slide plate, said orifice being elongated along an axis coincident with axis of misalignment and throttling.

95. In the valve of claim 94, yieldable means for holding the slide gate against the top plate.

96. In the valve of claim 95 above, a throttling cylinder coupled by means of a bell crank to a crank shaft, a yoke positioned along the crank shaft, and opposed push rods coupled to said yoke for engaging a slide gate and moving the same laterally.

97. In the valve of claim 94 yieldable means for holding said member beneath the slide gate.

98. In the valve of claim 97 above, a throttling cylinder coupled by means of a bell crank to a crank shaft, a yoke positioned along the crank shaft, and opposed push rods coupled to said yoke for engaging a slide gate and moving the same laterally.

99. In the valve of claim 93, yieldable means for holding the slide gate against the top plate.

100. In the valve of claim 99 above, a throttling cylinder coupled by means of a bell crank to a crank shaft, a yoke positioned along the crank shaft, and opposed push rods coupled to said yoke for engaging a slide gate and moving the same laterally.

101. In the valve of claim 93, yieldable means for holding said member beneath the slide gate.

102. In the valve of claim 101 above, a throttling cylinder coupled by means of a bell crank to a crank shaft, a yoke positioned along the crank shaft, and opposed push rods coupled to said yoke for engaging a slide gate and moving the same laterally.

103. In the valve of claim 93 above, a throttling cylinder coupled by means of a bell crank to a crank shaft, a yoke positioned along the crank shaft, and opposed push rods coupled to said yoke for engaging a slide gate and moving the same laterally.

104. In the valve of claim 103, yieldable means for holding said member beneath the slide gate.

105. In the valve of claim 93 above, a submergible pour tube extending below the surface of the metal being teemed from said valve, means for coupling said collector member to the submergible pour tube for supporting the same.

106. In the valve of claim 93 above, means for sequentially replacing the collector member at the same time the slide gate is replaced, said means for sequentially replacing being in addition to the means for sequentially positioning the slide gates and means for misaligning the slide gates.

107. In the valve of claim 93 above, means for sequentially replacing the collector member independent of replacing the slide gate, said means for sequentially replacing being in addition to the means for sequentially positioning the slide gate and the means for misaligning the slide gates.

108. A sliding gate valve for throttling of metal while being teemed from a vessel comprising, a top plate positioned beneath the vessel having an orifice in open communication with a teeming opening in the bottom of the vessel, a sliding gate frame at the lower portion of the teeming vessel arranged to support and guide slide gates, a collector member below the slide gates, slide gates, perforate with teeming openings, and imperforate without teeming openings arranged in the sliding gate frame so that they may be sequentially positioned beneath the top plate orifice and teeming opening in the bottom of the vessel, a collector member having a teeming orifice positioned beneath the slide gate in substantially fixed orientation with regard to the slide gate in the teeming position, means for holding said collector member in fluid tight relationship to the slide gate and for holding said slide gate in fluid tight relationship to the top plate, means for sequentially positioning the slide gates beneath the top plate orifice and above the collector member orifice, means in addition to and independent of the means for sequential positioning slide gates for misaligning the slide gates from their full flow position, whereby the teeming stream may be throttled.

109. In the valve of claim 108, an elongate orifice in the slide plate, said orifice being elongated along an axis coincident with the path of misalignment and throttling.

110. In the valve of claim 109 above, a throttling cylinder coupled by means of a bell crank to a crank shaft, a yoke positioned along the crank shaft, and opposed push rods coupled to said yoke for engaging a slide gate and moving the same laterally.

111. In the valve of claim 109, yieldable means for holding the slide gate against the top plate.

112. In the valve of claim 111 above, a throttling cylinder coupled by means of a bell crank to a crank shaft, a yoke positioned along the crank shaft, and opposed push rods coupled to said yoke for engaging a slide gate and moving the same laterally.

113. In the valve of claim 109, yieldable means for holding said member beneath the slide gate.

114. In the valve of claim 113, yieldable means for holding said member beneath the slide gate.

115. In the valve of claim 108, yieldable means for holding the slide gate against the top plate.

116. In the valve of claim 115 above, a throttling cylinder coupled by means of a bell crank to a crank shaft, a yoke positioned along the crank shaft, and opposed push rods coupled to said yoke for engaging a slide gate and moving the same laterally.

117. In the valve of claim 108, yieldable means for holding said member beneath the slide gate.

118. In the valve of claim 117 above, a throttling cylinder coupled by means of a bell crank to a crank shaft, a yoke positioned along the crank shaft, and opposed push rods coupled to said yoke for engaging a slide gate and moving the same laterally.

119. In the valve of claim 108 above, a throttling cylinder coupled by means of a bell crank to a crank shaft, a yoke positioned along the crank shaft, and opposed push rods coupled to said yoke for engaging a slide gate and moving the same laterally.

120. In the valve of claim 108 above, a submergible pour tube extending below the surface of the metal being teemed from said valve, means for coupling said collector member to the submergible pour tube for supporting the same.

121. In the valve of claim 108 above, means for sequentially replacing the collector member at the same time the slide gate is replaced, said means being in addition to the means for sequentially positioning the slide gates and means for misaligning the slide gates.

122. In the valve of claim 108 above, means for sequentially replacing the collector member independent of replacing the slide gate, said means for sequentially replacing being in addition to the means for sequentially positioning the slide gate and the means for misaligning the slide gates.

123. The method for replacing a spent pour tube with a new pour tube in a valve for a vessel for teeming molten metals and having means for sequentially receiving and discharging a sliding gate above the pour tube along a predetermined axis of movement, said sliding gate having a teeming opening for alignment with a pouring orifice of the vessel comprising the steps of:

positioning the teeming opening in the sliding gate off centerline of said predetermined axis of movement through the valve, moving the sliding gate into pouring condition, shifting the sliding gate laterally to close off the pour, moving the new pour tube into position beneath the sliding gate thereby displacing the spent pour tube, commencing the pour again by reversing the lateral shift of the sliding gate.

* * * * *

UNITED STATES PATENT AND TRADEMARK OFFICE

CERTIFICATE OF CORRECTION

PATENT NO. : 4,415,103

DATED : November 15, 1983

INVENTOR(S) : Earl P. Shapland and Patrick D. King

It is certified that error appears in the above-identified patent and that said Letters Patent are hereby corrected as shown below:

Column 9, line 37, change "accmplished" to -- accomplished --.

Column 9, end of line 51 and beginning of line 52, change "mutually" to -- manually --.

Column 12, line 11, change "side" to -- slide --.

Column 12, claim 5, line 1, change "Appratus" to -- Apparatus --.

Column 13, claim 7, line 2, after "gate", insert -- moving --.

Column 15, claim 32, subparagraph (f), line 1, change "returing" to -- returning --.

Column 21, claim 91, line 4, change "as" to -- has --.

Signed and Sealed this

*Twenty-third* Day of *July 1985*

[SEAL]

*Attest:*

DONALD J. QUIGG

*Attesting Officer* *Acting Commissioner of Patents and Trademarks*